United States Patent [19]

Cardinal

[11] 4,171,650

[45] Oct. 23, 1979

[54] JAR LID LOOSENING DEVICE

[76] Inventor: John Cardinal, 3289 Homewood Ave., White Bear Lake, Minn. 55110

[21] Appl. No.: 859,014

[22] Filed: Dec. 9, 1977

[51] Int. Cl.[2] ..... B67B 7/36

[52] U.S. Cl. ..... 81/3.2; 81/3.32

[58] Field of Search ..... 53/317; 81/3.2, 3.3 R, 81/3.3 A, 3.32.3.33.3.34

[56] References Cited

U.S. PATENT DOCUMENTS

| | | | |
|---|---|---|---|
| 1,618,457 | 2/1927 | McGrath | 81/3.32 |
| 2,136,037 | 11/1938 | Blackman et al. | 53/317 |
| 2,726,028 | 12/1955 | Saumsiegle | 53/317 |
| 3,795,158 | 3/1974 | Morita | 81/3.32 |
| 3,950,801 | 4/1976 | Morrison | 81/3.2 X |

*Primary Examiner*—James G. Smith
*Attorney, Agent, or Firm*—Leo Gregory

[57] ABSTRACT

A jar lid loosening device for screw type jar lids consisting of a jar lid receiving member arranged to accommodate a range of different sized lids, a vertically moveable table to support and raise a jar to have the lid thereof come into a holding engagement with said lid receiving member, a motor driven endless screw raising said table, a motor driven sprocket chain rotating said lid receiving member to loosen said jar lid and a switch member causing a reverse rotation of said endless screw to lower said table and the jar therein, removing said lid from said lid receiving member.

2 Claims, 3 Drawing Figures

JAR LID LOOSENING DEVICE

BACKGROUND AND SUMMARY OF THE INVENTION

Screw type jar lids are initially tightly secured and are difficult to loosen and this is particularly the case with reference to persons not having strong hands. It is desirable therefore to have a device which can readily loosen jar lids.

The invention herein relates to a device particularly adapted to receive a jar having a screw lid thereon and to raise said jar and its lid into a holding engagement within a lid receiving member and having electrically driven means rotate said lid receiving means to loosen said lid and said means to withdraw said lid from said lid receiving member.

It is a particular object of this invention therefore to provide a device for loosening a jar lid which device is a convenient size and is easily used by a housewife.

It is another object of this invention to provide a device having a supporting table for frictional engagement of a jar placed thereon, said jar having a screw lid thereon, a lid receiving member spaced above said table, means with limited upward thrust raising said table for holding engagement of said lid within said lid receiving member, said lid receiving member being arranged to automatically accommodate a range of sizes of lids, means lowering said jar and retracting said lid from said lid receiving member.

These and other objects and advantages of the invention will be set forth in the following description made in connection with the accompanying drawings in which like reference characters refer to similar parts throughout the several views and in which.

DESCRIPTION OF A PREFERRED EMBODIMENT

Figure 1:
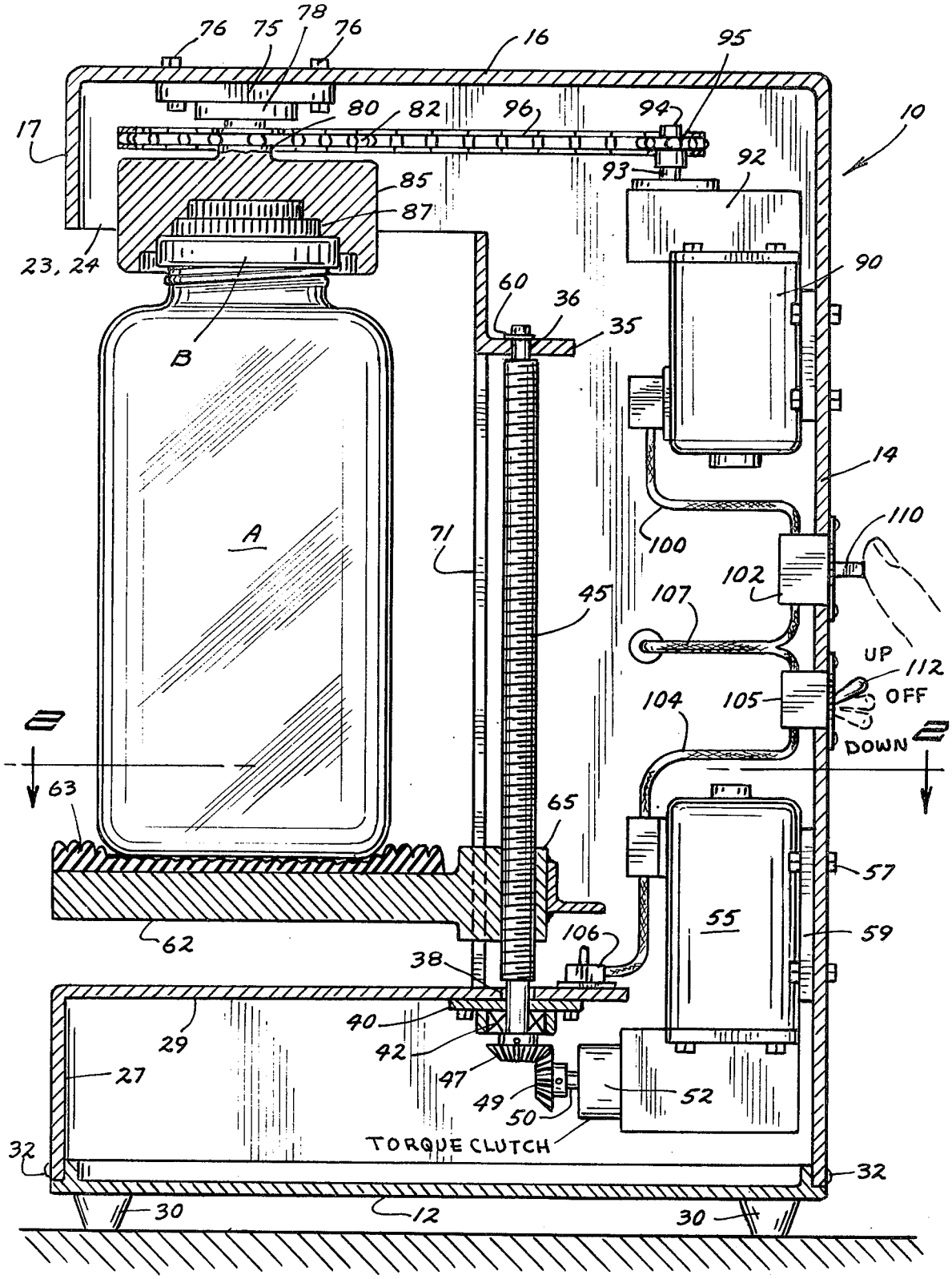
FIG. 1 is a view on an enlarged scale in vertical section.

Referring to the drawings, a preferred embodiment of the device comprising the invention herein is indicated by the reference numeral 10.

Said device comprises a base plate 12 having a back wall 14 extending upwardly therefrom with said wall having a upper end or top wall 16 extending forwardly having a front end depending wall portion 17.

Co-extensive with said back wall are vertical side walls 20 and 21 having upper forwardly extending side wall portions 23 and 24 integral with said top wall 16 and depending front end wall 17 and forming a canopy therewith.

Extending upwardly of the front end of base plate 12 is a front end wall 27 having a top plate member 29 extending between said side walls 20 and 21 and being integral therewith. Said bottom plate member is supported by small foot members 30 and is removably secured to said back wall 14 and front end wall 27 by bolts 32.

Said top wall 16 extends forwardly to be in vertical alignment with said wall 29. Disposed between said side walls 20 and 21 spaced downwardly from the upper end portions thereof is a horizontal shelf 35.

Said shelf 35 is apertured at 36 and said aperture has a conventional bearing surface therein. In vertical alignment with said aperture 36 is an opening 38 in said plate member 29 and underlying said opening 38 and extending thereabout is a plate member 40 having an underlying bearing 42. Journaled at one end in said aperture 36 and journaled through said bearing plate 42 at its other end is an elevating member 45 here shown as an endless screw member which is connected by a pair of bevel gears 47 and 49 with a shaft 50 which in turn is mounted in a torque clutch 52 carried by and being driven in a conventional manner by a motor 55, the connecting means of which are not here shown but are well known in the art and are deemed to require no specific description. Said motor 55 is mounted on the inner side of said back wall 14 secured by bolts 57 onto a mounting plate 59. The upper end of said screw member 45 is secured by a lock washer 60.

Mounted upon said screw 45 for travel upwardly and downwardly thereof by rotation of said screw member is a table member 62 having a non-smooth surface portion 63 of suitable material to form a frictional gripping base for jars disposed or positioned thereon. Said table 62 has a suitable extending hub portion 65 tapped to receive said screw member 45 therethrough for relative movement therewith vertically thereof.

Figure 2:
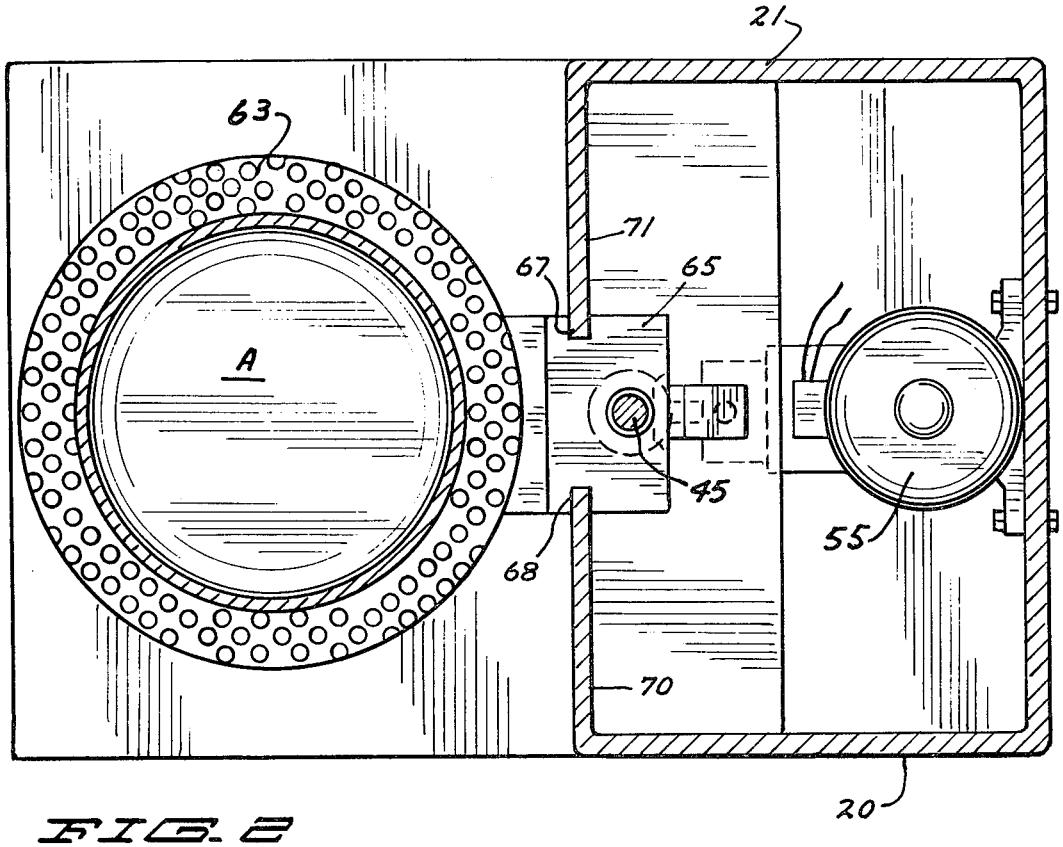
FIG. 2 is a view in horizontal section taken on line 2—2 of FIG. 1.

As shown in FIG. 2, said hub portion will have a pair of opposed vertical open sided grooves 67 and 68 therein to receive the adjacent portions of vertical walls 70 and 71 extending inward from said side walls 20 and 21. Said grooves by engagement with said walls 70 and 71 provide support for said plate member 62.

Secured to the underside of said upper wall 16 is a supporting plate member 75 secured by appropriate bolts 76 and carried by said plate member 75 is a flange bearing member 78 having a depending shaft 80 which carries a relatively large sprocket 82. Secured to and carried by said shaft 80 is a jar lid receiving and holding member 85. As shown in the present embodiment, said member 85 has a recessed portion 87 extending upwardly inwardly thereof which consists of a series of circular grooves of decreasing diameter to form an inwardly upwardly stepped portion with said grooves respectively being adapted to receive jar lids of a corresponding size. Thus jar lids of a range of sizes will be accommodated. Though not here shown, said circular grooves will have non-smooth gripping surfaces for holding engagement with said jar lids under suitable pressure, as will be described.

Mounted on the upper portion of said side wall 14 at the inner side thereof is a motor 90 having a driving connection with a torque clutch member 92 which is merely indicated here as a torque clutch member is well known in the art and it is deemed not necessary to show further detail. A vertical shaft 93 extends upwardly of said clutch member 92 and carries a relatively small sprocket 95 and a sprocket chain 96 passes over said sprockets 82 and 95. The relative sizes of the sprockets 82 and 95 are a matter of design.

An electric line 100 runs from said motor 90 to be in circuit with a switch member 102 and an electric line 104 runs from said motor 55 to be in circuit with toggle switch 105. Said lines 100 and 104 are in circuit with a cable 107 which runs to a suitable current supply.

The switch member or button 110 which is spring loaded to be normally in an off position operates the switch 102.

The toggle 112 of switch 105 has three positions as indicated, namely, off, down, and up positions.

The up position of the toggle 112 energizes the motor 55 to raise the table member 62 by rotating the screw member 45. Down position of the toggle 112 reverses the motor 55 to rotate the screw member 45 to lower the table 62. The motor 55 is automatically denergized by operation of a safety switch 106 when table 62 is in its down position. This safety switch is normally in on position and as shown is in circuit with line 104 and motor 55.

Figure 3:
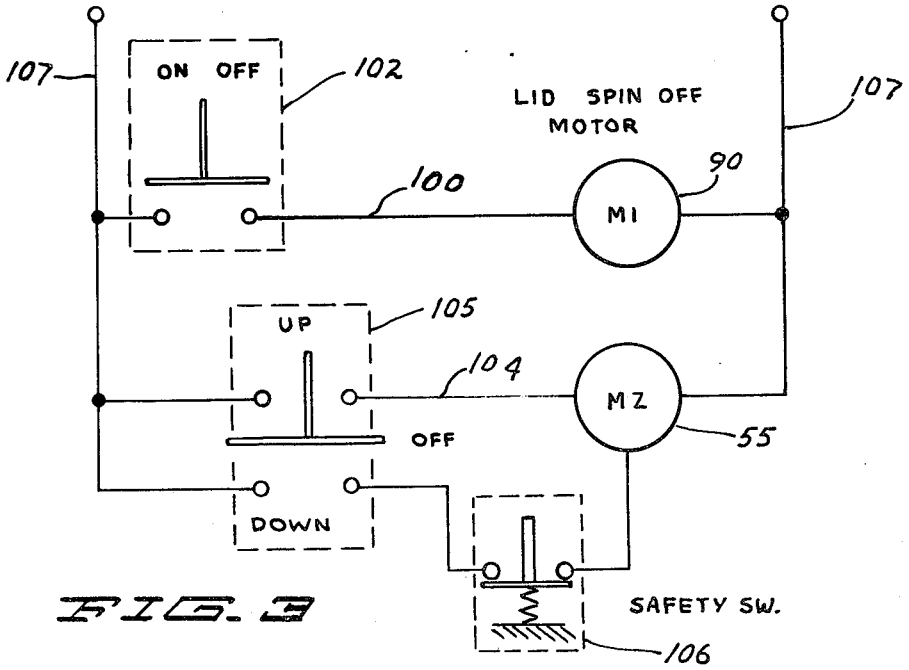
FIG. 3 is a schematic wiring diagram.

FIG. 3 shows a schematic wiring diagram which corresponds to the description above given with reference to the switch member 102, 105 and 106 and with their respective motors 90 and 55.

OPERATION

In view of the description above given, with the table member 62 in a lowered position, a jar A having a screw lid B secured thereon will be placed upon said table member and the operator will move the toggle 112 to its up position raising said table 62 for engagement of said screw lid B with a groove corresponding in size thereto within the lid receiving member 85. When the lid member B has been received within the lid receiving member 85, the torque clutch 52 will slip at the point at which maximum pressure is being applied as an upward force with respect to the jar A and this pressure will be sufficient for a holding engagement between the lid B and the lid receiving member 85. Thus the structure of the device provides the safety feature of not having such excessive upward thrust applied as would break the jar.

With the lid B thus being securely held, the operator will merely press inwardly the switch 110 to energize the motor 90 which in turn will drive the sprocket chain 96 to rotate the lid receiving member 85 sufficiently to merely loosen the lid B. This will be on the order of a surge of power acting upon the member 85 and there results but a small expenditure of electric energy. This operation takes but a second or two. The operator will then release the switch 110 and move the toggle switch 112 to down position to lower the table 62 and to remove the jar 80. The lid will then be removed from the jar by simple finger movement.

The operation of the device is safe and it is a simple operation for an operator to understand. The lid receiving member 85 by means of its inwardly upwardly stepped portion 87 is designed to accommodate the great majority of standard sized lids found in the market place.

Thus it is seen that I have provided a simply constructed and efficiently operated device for the purposes above described.

It will, of course, be understood that various changes may be made in the form, details, arrangement and proportions of the apparatus without departing from the scope of applicant's invention which, generally stated, consists in an apparatus capable of carrying out the objects above set forth, in the parts and combination of parts disclosed and defined in the appended claims.

I claim:

1. A jar lid loosening device, having in combination a frame structure having an extended base and an overhanging top plate member, an upstanding screw member journaled in said frame between said base and said top plate member, a jar supporting table member, a hub portion of said table member having said screw member threaded therethrough, said hub member having vertical oppositely disposed open sided vertical slots, edge portions of a pair of opposed wall members of said frame structure being disposed in said slots, a friction gripping surface portion overlying said table member, a jar lid receiving member rotatably depending from said top plate member, said jar lid receiving member having a recess comprising a jar lid friction engaging surface, electrical means carried by said frame structure driving said screw member, electrical operated means carried by said frame structure driving said jar lid receiving member, switch means respectively carried by said two mentioned electrical means actuating the same, and means carried by said base limiting the upward thrust of said table member by said screw member.

2. The structure of claim 1, wherein said last mentioned means comprises a clutch member having a drive shaft, gears connect said screw member and said drive shaft, and said last mentioned electrical means has said clutch member operatively mounted thereon.

* * * * *